US007760166B2

(12) United States Patent
Uchino et al.

(10) Patent No.: US 7,760,166 B2
(45) Date of Patent: Jul. 20, 2010

(54) DISPLAY APPARATUS AND ELECTRONIC DEVICE

(75) Inventors: Katsuhide Uchino, Tokyo (JP); Junichi Yamashita, Tokyo (JP); Naobumi Toyomura, Kanagawa (JP)

(73) Assignee: Sony Corporation, Tokyo (JP)

( * ) Notice: Subject to any disclaimer, the term of this patent is extended or adjusted under 35 U.S.C. 154(b) by 562 days.

(21) Appl. No.: 11/826,255

(22) Filed: Jul. 13, 2007

(65) Prior Publication Data

US 2008/0030440 A1 Feb. 7, 2008

(30) Foreign Application Priority Data

Jul. 19, 2006 (JP) ..... 2006-196874

(51) Int. Cl.
*G09G 3/30* (2006.01)

(52) U.S. Cl. ..... 345/76; 345/45; 345/77; 345/82; 315/169.1; 315/169.3

(58) Field of Classification Search ..... 345/39, 345/44–46, 76–84, 204–214, 690–693; 315/169.1–169.3
See application file for complete search history.

(56) References Cited

U.S. PATENT DOCUMENTS 6,356,029 B1 * 3/2002 Hunter ..... 315/169.1
7,646,363 B2 * 1/2010 Yamashita et al. ..... 345/76
2005/0012686 A1 * 1/2005 Osame et al. ..... 345/39

FOREIGN PATENT DOCUMENTS

| | | |
|---|---|---|
| JP | 2003-255856 | 9/2003 |
| JP | 2003-271095 | 9/2003 |
| JP | 2004-029791 | 1/2004 |
| JP | 2004-093682 | 3/2004 |
| JP | 2004-133240 | 4/2004 |

* cited by examiner

*Primary Examiner*—Lun-Yi Lao
*Assistant Examiner*—Jennifer T Nguyen
(74) *Attorney, Agent, or Firm*—Rader, Fishman & Grauer PLLC

(57) ABSTRACT

A display apparatus, comprising a pixel array section and a drive section that drives the pixel array section, wherein the pixel array section includes first scanning lines and second scanning lines arranged in rows, signals lines arranged in columns, matrix pixels that are provided where the first scanning lines, the second scanning lines, and the signal lines cross, and a power line that supplies power to each of the pixels, and an earth line. The drive section includes a first scanner that sequentially line scans the pixels in rows by sequentially supplying a first control signal to each of the first scanning lines, a second scanner that sequentially supplies a second control signal to each of the second scanning lines in conjunction with the sequential line scanning, and a signal selector that supplies video signals to the columns of signal lines in conjunction with the sequential line scanning.

4 Claims, 10 Drawing Sheets

$$I_{ds} = k\mu\,(V_{gs}-V_{th})^2 = k\mu\,(V_{sig}-\Delta V)^2$$

DISPLAY APPARATUS AND ELECTRONIC DEVICE

BACKGROUND OF THE INVENTION

1. Field of the Invention

The present invention relates to a display apparatus that displays images by driving light emitting elements arranged by pixels by an electric current. More specifically, the present invention relates to a display apparatus of the so-called active matrix type in which the amount of current that is passed through a light emitting element, such as an organic EL element and the like, is controlled by an insulated gate type field effect transistor that is provided in each pixel circuit. More specifically, the present invention relates to a technology for optimizing the size of the transistor that is formed in each of the pixel circuits, and it also relates to an electronic device into which such a display apparatus is incorporated.

2. Description of Related Art

In image displaying apparatuses, such as liquid crystal displays, for example, numerous liquid crystal pixels are arranged in a matrix, and an image is displayed by controlling the transmission intensity or reflection intensity with respect to the incident light for each pixel in accordance with the image information for the image to be displayed. The same principle applies to an organic EL display that uses organic EL elements for its pixels, but unlike liquid crystal pixels, organic EL elements emit light themselves. As a result, organic EL displays offer such advantages over liquid crystal displays as better visibility of image, faster response speed, not requiring a backlight, and so forth. In addition, the brightness level (scale) of each light emitting element is controllable by way of the value of the current that flows therethrough, and thus organic EL displays differ from liquid crystal displays, which are controlled by voltage, in that they are controlled by current.

With organic EL displays, as with liquid crystal displays, there is the simple matrix method and the active matrix method with respect to their driving methods. While the former has a simple structure, it has a problem in that application to large and high definition displays is difficult. As a result, development of the active matrix method is currently being actively pursued. This method is one in which the current that flows through the light emitting element within each pixel circuit is controlled by an active element (generally, a thin film transistor (TFT)) that is provided within the pixel circuit, and descriptions thereof can be found in the following patent documents.

[Patent Document 1] Japanese Patent Application Publication No. JP 2003-255856

[Patent Document 2] Japanese Patent Application Publication No. JP 2003-271095

[Patent Document 3] Japanese Patent Application Publication No. JP 2004-133240

[Patent Document 4] Japanese Patent Application Publication No. JP 2004-029791

[Patent Document 5] Japanese Patent Application Publication No. JP 2004-093682

SUMMARY OF THE INVENTION

A related art pixel circuit is provided at a position where a row of a scanning line that supplies control signals and a column of a signal line that supplies video signals cross, and includes at least a sampling transistor, a pixel capacitance, a drive transistor, and a light emitting element. The sampling transistor becomes conductive in accordance with the control signal supplied by the scanning line, and samples the video signal supplied by the signal line. The pixel capacitance holds an input voltage corresponding to the signal potential of the video signal that has been sampled. The drive transistor supplies as a drive current an output current over a predetermined light emitting period in accordance with the input voltage held by the pixel capacitance. It is noted that, in general, the output current is dependent on the carrier mobility of the channel region of and the threshold voltage of the drive transistor. The light emitting element emits light at a brightness corresponding to the video signal by means of the output current that is supplied by the drive transistor.

The drive transistor receives the input voltage held by the pixel capacitance at its gate and allows an output current to flow across its source and drain, thereby allowing a current to flow to the light emitting element. In general, the light emitting brightness of the light emitting element is proportional to the current applied. Further, the amount of the output current supplied by the drive transistor is controlled by the gate voltage, in other words the input voltage written in the pixel capacitance. In a conventional pixel circuit, the amount of current that is supplied to the light emitting element is controlled by varying the input voltage applied to the gate of the drive transistor in accordance with the input video signal.

The operating characteristics of the drive transistor can be expressed by Equation 1 below:

$$Ids=(1/2)\mu(W/L)Cox(Vgs-Vth)^2 \qquad \text{Equation 1}$$

In Equation 1, Ids represents the drain current that flows across the source and the drain, and in the pixel circuit, it is the output current that is supplied to the light emitting element. Vgs represents the gate voltage that is applied to the gate with the source as a reference, and in the pixel circuit, it is the input voltage. Vth is the threshold voltage of the transistor. In addition, μ represents the mobility of the semiconductor thin film that makes up the channel of the transistor. W represents the channel width, L represents the channel length, and Cox represents the gate capacitance. As is apparent from Equation 1, when the thin film transistor operates in the saturation region, as the gate voltage Vgs increases in excess of the threshold voltage Vth, it enters an ON state and the drain current Ids flows through. In principle, as is indicated by Equation 1, so long as the gate voltage Vgs is uniform, a constant amount of drain current Ids is supplied to the light emitting element. Therefore, if a video signal of the same level is supplied to all of the pixels making up a screen, all pixels should emit light with the same brightness, and uniformity of the screen should be achieved.

However, in practice, thin film transistors (TFT) that include a semiconductor thin film of, for example, polysilicon and the like vary in their device characteristics. In particular, the threshold voltage Vth is not uniform, and varies from pixel to pixel. As can be seen from Equation 1 above, when the threshold voltage Vth of each drive transistor varies, the drain current Ids will vary even if the gate voltage Vgs is uniform, and cause the brightness to vary from pixel to pixel, and therefore uniformity of the screen is thus compromised. Pixel circuits with built-in functions for cancelling variations in the threshold voltage of drive transistors have been developed and are disclosed in, for example, Patent Document 3 mentioned above.

However, what causes the output current supplied to the light emitting element to vary is not just the threshold voltage Vth of the drive transistor. As is apparent from Equation 1 above, even when the mobility μ of the drive transistor varies, the output current Ids varies. As a result, uniformity of the screen is compromised. Correcting for variations in mobility is also an issue to be resolved.

In view of the issues described above that are associated with the related art technology, it is desirable to provide a display apparatus in which mobility correction function of a drive transistor is incorporated into each of its pixels. It is also desirable to provide a display apparatus in which the size of the transistors formed in the pixels is optimized in such a manner that the mobility correction functions works properly. In an embodiment of the present invention, the following measures are taken. A display apparatus of the present embodiment includes a pixel array section and a drive section that drives the pixel array section. The pixel array section may include rows of first scanning lines and second scanning lines, columns of signal lines, matrix of pixels provided where the scanning lines and signal lines cross, a power line that provides power to each of the pixels, and an earth line. The drive section may include a first scanner that sequentially supplies a first control signal to each of the first scanning lines and that sequentially line scans the pixels row by row, a second scanner that sequentially supplies a second control signal to each of the second scanning lines in accordance with the sequential line scanning, and a signal selector that supplies video signals to the columns of signal lines in accordance with the sequential line scanning. Each of the pixels may include a light emitting element, a sampling transistor, a drive transistor, a switching transistor, and a pixel capacitance. With respect to the sampling transistor, its gate is connected to the first scanning line, its source is connected to the signal line, and its drain is connected to the gate of the drive transistors. The drive transistor and the light emitting element are connected in series between the power line and the earth line to form a current path. The switching transistor is inserted in the current path, and at the same time, its gate is connected to the second scanning line. The pixel capacitance is connected between the source and the gate of the drive transistor. The sampling transistor turns on in accordance with the first control signal that is supplied from the first scanning line, samples the signal potential of the video signal supplied from the signal line and holds it in the pixel capacitance. The switching transistor turns on in accordance with the second control signal supplied from the second scanning lines to place the current path in a conductive state. The drive transistor, in accordance with the signal potential held by the pixel capacitance, passes a drive current to the light emitting element via the current path that is placed in a conductive state. After applying the first control signal to the first scanning line to turn on the sampling transistor and starting the sampling of the signal potential, the drive section negatively feeds back the drive current that flows from the drive transistor to the pixel capacitance, and thereby the drive section corrects the signal potential held by the pixel capacitance in accordance with the mobility of the drive transistor, during a correction period, which is between a first timing at which the switching transistor turns on when the second control signal is applied to the second scanning line and a second timing at which the sampling transistor turns off when the first control signal applied to the first scanning line is terminated. In so doing, what is characteristic is that the size of the switching transistor is made larger than the size of the drive transistor so that the on resistance of the switching transistor would be lower than the on resistance of the drive transistor.

It is preferable that the channel width size of the switching transistor is at least four times as large as that of the drive transistor so that the on resistance of the switching transistor would be a quarter or less of that of the drive transistor. In addition, each pixel includes an additional switching transistor that resets the gate potential and source potential of the drive transistor prior to the sampling of the video signals. The second scanner temporarily turns on the switching transistor via the second scanning lines prior to the sampling of the video signals. By applying a drive current to the drive transistor that is thus reset, a voltage corresponding to the threshold voltage thereof is held by the pixel capacitance.

According to the present invention, utilizing part of a period in which the signal potential is sampled to the pixel capacitance (sampling period), the mobility of the drive transistor is corrected. More specifically, in the latter part of the sampling period, the switching transistor is turned on to put the current path in a conductive state, and a drive current is supplied to the drive transistor. This drive current has a magnitude corresponding to the sampled signal potential. At this stage, the light emitting element is in a reverse biased state, the drive current does not flow through the light emitting element and is charged to the parasitic capacitance thereof or the pixel capacitance. Then, the sampling pulse falls, and the gate of the drive transistor is cut off from the signal lines. During the correction period from when the switching transistor turns on up to when the sampling transistor turns off, the drive current is negatively fed back to the pixel capacitance from the drive transistor, and an amount corresponding thereof is subtracted from the signal potential sampled to the pixel capacitance. Since this negatively fed back amount works in a suppressive direction with respect to variations in the mobility of the drive transistor, mobility can be corrected for each pixel. In other words, when the mobility of the drive transistor is large, the amount of negative feedback with respect to the pixel capacitance becomes greater, the signal potential held by the pixel capacitance is greatly reduced, and the output current of the drive transistor is suppressed as a result. On the other hand, when the mobility of the drive transistor is small, the amount of negative feedback is also small, and the signal potential held by the pixel capacitance is not so affected. Therefore, the output current of the drive transistor does not decrease much. Here, the amount of negative feedback is at a level that corresponds to the signal potential that is directly applied to the gate of the drive transistor from the signal lines. In other words, as the signal potential becomes higher and the brightness greater, the amount of negative feedback becomes greater. Thus, mobility correction is performed in accordance with the brightness level.

With the present invention, the sizes of the switching transistor and the drive transistor are devised in such a manner that the mobility corrective function operates appropriately. In other words, the size of the switching transistor is made larger than the size of the drive transistor so that the on resistance of the switching transistor would be lower than the on resistance of the drive transistor. As described above, with the present invention, mobility correction is performed by negatively feeding back to the pixel capacitance the drive current flowing from the drive transistor. In so doing, the amount of negative feedback increases as the signal potential becomes higher (and therefore the brightness greater). In other words, when the brightness is high, the amount of drive current flowing through the switching transistor and the drive transistor becomes greater. Therefore, as the brightness becomes higher, variations in the on resistance of the switching transistors become more pronounced. As such, effects of variations in the on resistance of the switching transistor at high-brightness side appear even though variations in the mobility of the drive transistor (in other words, variations in the on resistance of the drive transistor) are corrected for, and uniformity of the screen would thus be compromised. As such, by reducing the on resistance of the switching transistor to, preferably, a quarter or below of the on resistance of the drive transistor, effects on the amount of negative feedback are suppressed. With such a configuration, such image degradation as uneven streaks that are caused by variations in the on resistance of the switching transistors at high brightness scales is resolved, and it is thus possible to further improve uniformity.

DETAILED DESCRIPTION OF EMBODIMENTS

Figure 1:
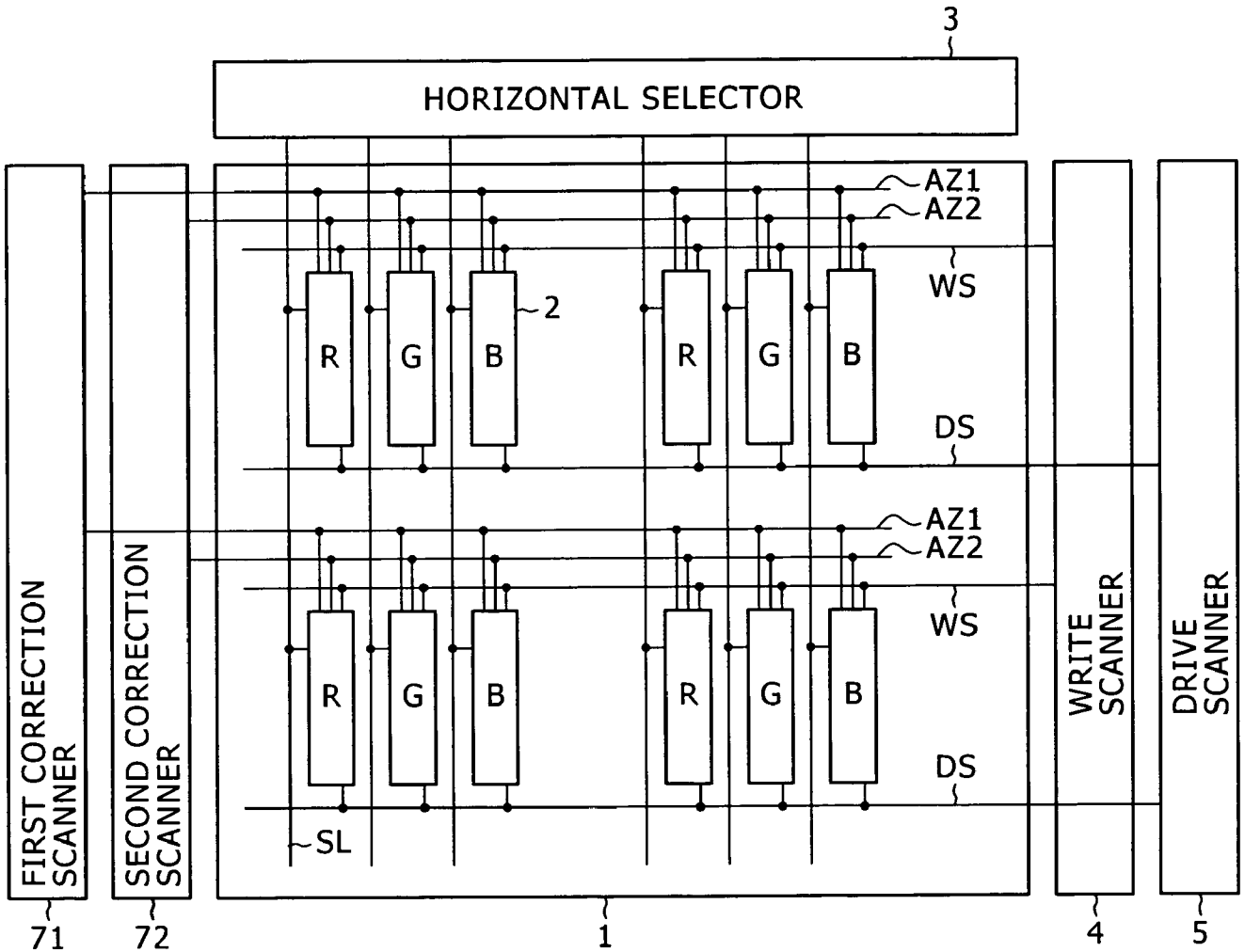
FIG. 1 is a block diagram indicating the overall configuration of a display apparatus according to an embodiment of the present invention.

Embodiments of the present invention are described in detail with reference to the drawings. FIG. 1 is a schematic block diagram indicating the overall configuration of a display apparatus according to an embodiment of the present invention. In this diagram, the image display apparatus basically includes a pixel array section 1, and a drive section that includes a scanner section and a signal section. The pixel array section 1 includes scanning lines WS, AZ1, AZ2 and DS that are arranged in rows, signal lines SL that are arranged in columns, and matrix pixel circuits 2, which are connected to these scanning lines WS, AZ1, AZ2 and DS, and the signal lines SL, and a plurality of power lines which supply a first potential Vss1, a second potential Vss2, and a third potential Vcc which are necessary for operation of each of the pixel circuits 2. The signal section includes a horizontal selector 3, and supplies video signals to the signal lines SL. The scanner section includes a light scanner 4, a drive scanner 5, a first correction scanner 71 and a second correction scanner 72, and they supply control signals to the scanning lines WS, DS, AZ1 and AZ2, respectively, and sequentially scan the pixel circuits row by row.

Figure 2:
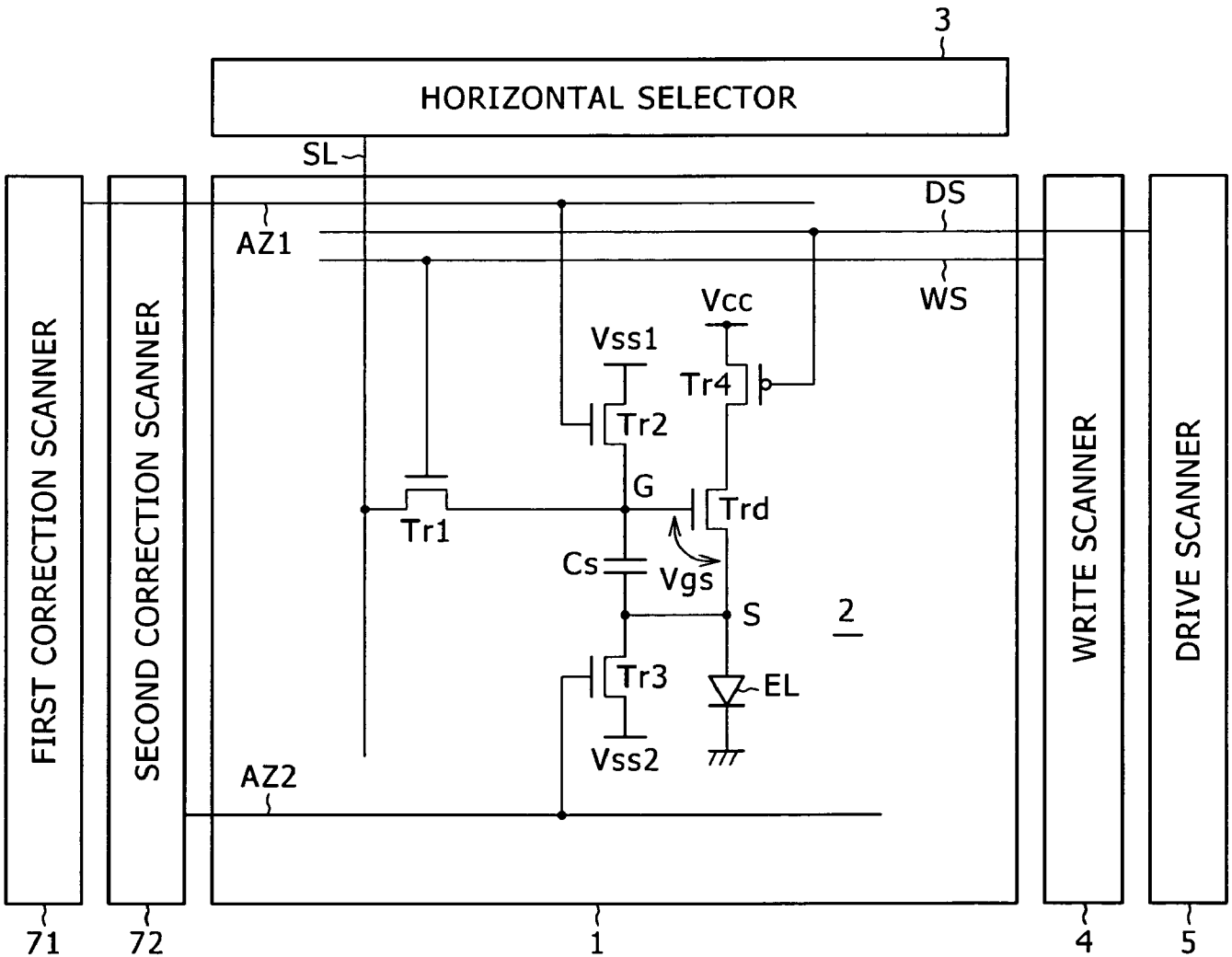
FIG. 2 is a circuit diagram indicating the configuration of pixels included in the display apparatus shown in FIG. 1.

FIG. 2 is a circuit diagram indicating a configuration example of the pixel circuits incorporated in the image display apparatus shown in FIG. 1. As shown in the diagram, the pixel circuit 2 includes a sampling transistor Tr1, a drive transistor Trd, a first switching transistor Tr2, a second switching transistor Tr3, a third switching transistor Tr4, a pixel capacitance Cs, and a light emitting element EL. The sampling transistor Tr1 becomes conductive in accordance with a control signal supplied from the scanning line WS during a predetermined sampling period, and samples to the pixel capacitance Cs the signal potential of the video signal supplied from the signal line SL. The pixel capacitance Cs applies an input voltage Vgs to a gate G of the drive transistor Trd in accordance with the signal potential of the video signal that has been sampled. The drive transistor Trd supplies to the light emitting element EL an output current Ids corresponding to the input voltage Vgs. The light emitting element EL emits light at a brightness corresponding to the signal potential of the video signal by way of the output current Ids that is supplied from the drive transistor Trd during a predetermined light emitting period.

The first switching transistor Tr2 becomes conductive in accordance with a control signal that is supplied from the scanning line AZ1 prior to the sampling period, and sets the gate G of the drive transistor Trd to the first potential Vss1. The second switching transistor Tr3 becomes conductive in accordance with a control signal that is supplied from the scanning line AZ2 prior to the sampling period, and sets a source S of the drive transistor Trd to the second potential Vss2. The third switching transistor Tr4 becomes conductive in accordance with a control signal that is supplied from the scanning line DS prior to the sampling period, and connects the drive transistor Trd to the third potential Vcc, and thus corrects for the effects of a threshold voltage Vth of the drive transistor Trd by having a voltage corresponding to the threshold voltage Vth be held by the pixel capacitance Cs. Further, this third switching transistor Tr4 becomes conductive in accordance with a control signal that is again supplied from the scanning line DS during the light emitting period, thereby connecting the drive transistor Trd to the third potential Vcc, and lets the output current Ids flow to the light emitting element EL.

As can be seen from the description above, the pixel circuits 2 includes the five transistors Tr1 to Tr4 and Trd, the one pixel capacitance Cs, and one light emitting element EL. The transistors Tr1 to Tr3 and Trd are N-channel type polysilicon TFTs. Only the transistor Tr4 is a P-channel type polysilicon TFT. However, the present invention is not limited thereto, and it is possible to use an appropriate mix of N-channel type TFTs and P-channel type TFTs. The light emitting element EL is, for example, an organic EL device of a diode type that is equipped with an anode and a cathode. However, the present invention is not limited thereto, and the light emitting element here may include all devices in general that are driven by a current to emit light.

Figure 3:
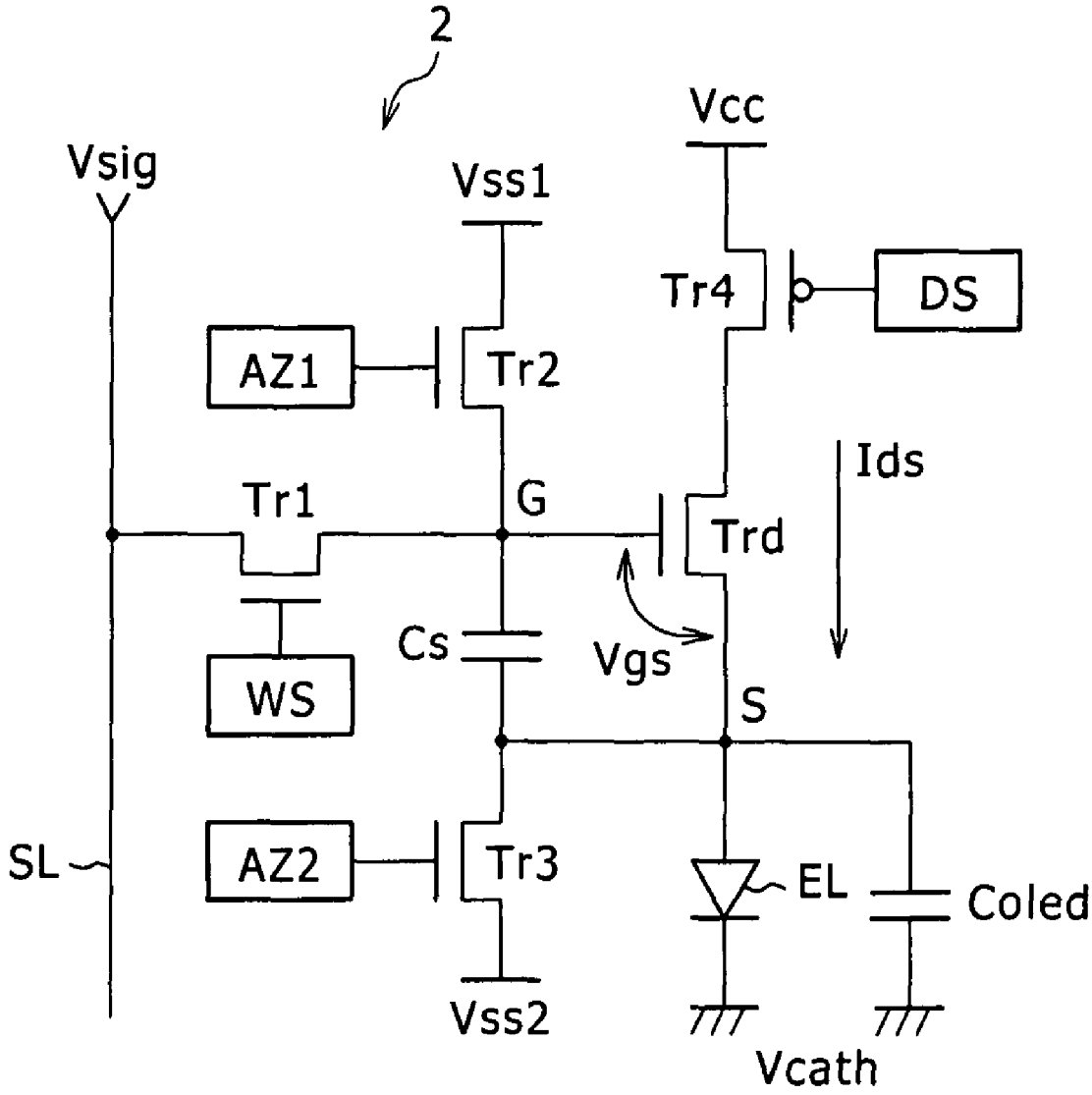
FIG. 3 is a schematic diagram that is to aid in explaining the operations of a display apparatus according to an embodiment of the present invention.

FIG. 3 is a schematic diagram in which only the pixel circuit 2 portion is taken out from the image display apparatus shown in FIG. 2. In order to facilitate easier understanding, a signal potential Vsig of the video signal sampled by the sampling transistor Tr1, the input voltage Vgs of the drive transistor Trd, the output current Ids, and further, a capacitance component Coled held by the light emitting element EL, and the like are additionally written in. Operations of the pixel circuit 2 according to an embodiment of the present invention will be described based on FIG. 3.

Figure 4:
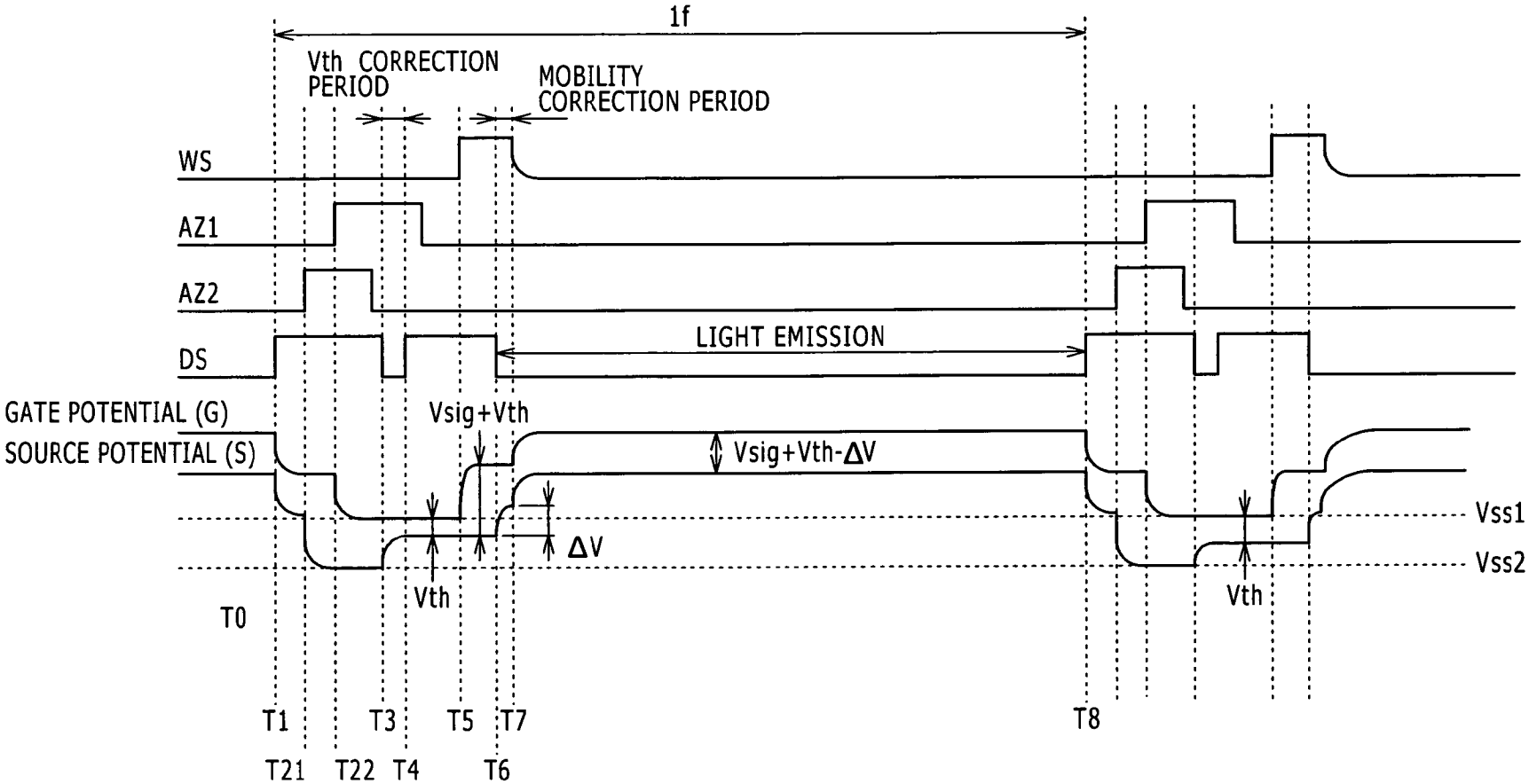
FIG. 4 is a timing chart that should similarly aid in explaining operations.

FIG. 4 is a timing chart for the pixel circuit shown in FIG. 3. With reference to FIG. 4, operations of the pixel circuit according to an embodiment of the present invention and shown in FIG. 3 will be described in detail. Along a time axis T, FIG. 4 indicates the wave patterns of the control signals applied to each of the scanning lines WS, AZ1, AZ2 and DS. In order to simplify the representation, the control signals are indicated with the same reference symbols as those of the corresponding scanning lines. Since the transistors Tr1, Tr2, and Tr3 are N-channel type, they turn on when the scanning lines WS, AZ1, and AZ2, respectively, are at high levels, and turn off when they are at low levels. On the other hand, since the transistor Tr4 is a P-channel type, it turns off when the scanning line DS is at a high level and turns on when the scanning line DS is at a low level. It is noted that this timing chart shows, along with the wave patterns of each of the control signals WS, AZ1, AZ2 and DS, changes in the potential of the gate G, as well as of the source S, of the drive transistor Trd.

For the timing chart in FIG. 4, timings T1 through T8 are taken to be one field (1f). During one field, each row of the pixel array is sequentially scanned once. This timing chart indicates the wave patterns of each of the control signals WS, AZ1, AZ2 and DS that are applied to a row of pixels.

At timing T0 before the field begins, all of the control signals WS, AZ1, AZ2, and DS are at low levels. Therefore, while the N-channel type transistors Tr1, Tr2, and Tr3 are in an off state, the P-channel type transistor Tr4 alone is in an on state. Therefore, since the drive transistor Trd is connected with the power source Vcc via the transistor Tr4, which is in an on state, the drive transistor Trd supplies to the light emitting element EL the output current Ids corresponding to the predetermined input voltage Vgs. Thus, at timing T0, the light emitting element EL is emitting light. Here, the input voltage Vgs that is applied to the drive transistor Trd can be expressed by the difference between the gate potential (G) and the source potential (S).

At timing T1 at which the field begins, the control signal Ds switches from a low level to a high level. As a result, the transistor Tr4 turns off, and the drive transistor Trd is cut off from the power source Vcc, and the emission of light is terminated, and a non-light emitting period thus begins. Therefore, upon entering timing T1, all of the transistors Tr1 to Tr4 enter an off state.

Following timing T1, the control signal AZ2 rises at timing T21, and the switching transistor Tr3 turns on. As a result, the source (S) of the drive transistor Trd is initialized to the predetermined potential Vss2. Subsequently, at timing T22, the control signal AZ1 rises, and the switching transistor Tr2 turns on. As a result, the gate potential (G) of the drive transistor Trd is initialized to the predetermined potential Vss1. As a result, the gate G of the drive transistor Trd is connected with the reference potential Vss1, and the source S is connected with the reference potential Vss2. Here, the condition Vss1−Vss2>Vth is satisfied, and the Vth correction that is performed thereafter at timing T3 is prepared for by satisfying Vss1−Vss2=Vgs>Vth. In other words, the period between T21 and T3 corresponds to a resetting period for the drive transistor Trd. In addition, assuming that the threshold voltage of the light emitting element EL is VthEL, VthEL is set to be greater than Vss2. As a result, a minus bias is applied to the light emitting element EL, and the light emitting element EL is placed in a so-called reverse bias state. This reverse bias state is necessary in order to properly perform the Vth correction operation and mobility correction operation which is performed later on.

At timing T3, after the control signal AZ2 is lowered to a low level, the control signal Ds is lowered to a low level. Thus, while the transistor Tr3 turns off, the transistor Tr4 turns on. As a result, a drain current Ids flows to the pixel capacitance Cs, and the Vth correction operation is initiated. At this point, the gate G of the drive transistor Trd is held at Vss1, and the current Ids flows until the drive transistor Trd is cut off. Once the drive transistor Trd is cut off, the source potential (S) of the drive transistor Trd becomes Vss1−Vth. At timing T4, which is after the drain current is cut off, the control signal Ds is returned to a high level, and the switching transistor Tr4 is turned off. Further, the control signal AZ1 is also returned to a low level, and the switching transistor Tr2 is also turned off. As a result, Vth is held and fixed at the pixel capacitance Cs. As described above, the period between timing T3 and timing T4 is a period for detecting the threshold voltage Vth of the drive transistor Trd. Hereinafter, this detection period T3-T4 will be referred to as the Vth correction period.

After the Vth correction is performed as described above, the control signal WS is switched to a high level at timing T5 to turn the sampling transistor Tr1 on, and the signal potential Vsig of the video signal is written in the pixel capacitance Cs. The pixel capacitance Cs is sufficiently small compared to the capacitance Coled equivalent to that of the light emitting element EL. As a result, a substantial majority of the signal potential Vsig of the video signal is written in the pixel capacitance Cs. More precisely, the difference between Vss1 and Vsig, that is, Vsig−Vss1, is written in the pixel capacitance Cs. Therefore, the voltage Vgs between the gate G and the source S of the drive transistor Trd is at a level where Vth, which is detected and held in advance, and Vsig−Vss1, which is sampled as described directly above, are added together (in other words, Vsig−Vss1+Vth). For purposes of simplicity, if it is assumed that Vss1=0V, the voltage Vgs across the gate and the source becomes Vsig+Vth, as indicated in the timing chart in FIG. 4. The sampling of the signal potential Vsig of the video signal is continued up to timing T7 at which the control signal WS returns to a low level. In other words, the period between T5 and T7 corresponds to a sampling period.

At timing T6, which comes before timing T7 at which the sampling period terminates, the control signal Ds becomes low level, and the switching transistor Tr4 turns on. Thus, the drive transistor Trd is connected with the power source Vcc, and the pixel circuit proceeds from a non-light emitting period to a light emitting period. During period T6-T7 in which the sampling transistor Tr1 is still in an on state and in which the switching transistor Tr4 has entered an on state as described above, the mobility correction for the drive transistor Trd is performed. In other words, with the present invention, mobility correction is performed during period T6-T7 in which the latter part of the sampling period and the beginning part of the light emitting period overlap. It is noted that in the beginning of the light emitting period during which the mobility correction is performed, the light emitting element EL is in fact in a reverse bias state, and therefore does not emit light. During this mobility correction period T6-T7, the drain current Ids flows through the drive transistor Trd in a state where the gate G of the drive transistor Trd is fixed at the level of the signal potential Vsig of the video signal. Here, by setting Vss1-Vth to be less than VthEL in advance, the light emitting element EL is placed in a reverse bias state, and therefore exhibits not diode characteristics, but simple capacitive characteristics. Thus, the current Ids that flows through the drive transistor Trd is written in a capacitance C=Cs+Coled, which is a combination of the pixel capacitance Cs and the capacitance Coled equivalent to that of the light emitting element EL. As a result, the source potential (S) of the drive transistor Trd rises. In the timing chart in FIG. 4, this rise is expressed as ΔV. Since this rise ΔV is eventually subtracted from the voltage Vgs across the gate and the source that is held by the pixel capacitance Cs, it means a negative feedback is applied. By feeding back the output current Ids of the drive transistor Trd to the input voltage Vgs of the drive transistor Trd as described above, it is possible to correct mobility μ. It is noted that by adjusting the timing width t of the mobility correction period T6-T7, the negative feedback amount ΔV can be optimized. To this end, a gradient is given to the falling of the control signal WS.

At timing T7, the control signal WS is at a low level, and the sampling transistor Tr1 turns off. As a result, the gate G of the drive transistor Trd is cut off from the signal line SL. Since the application of the signal potential Vsig of the video signal is terminated, the gate potential (G) of the drive transistor Trd is now able to rise, and rises along with the source potential (S). Meanwhile, the voltage Vgs across the gate and the source that is held by the pixel capacitance Cs maintains the value of (Vsig−ΔV+Vth). As the source potential (S) rises, the reverse bias state of the light emitting element EL is resolved, and therefore , the light emitting element EL begins to actually emit light by inflow of the output current Ids. At this point, the relationship between the drain current Ids and the gate voltage Vgs can be expressed by Equation 2 below by substituting Vsig−ΔV+Vth for Vgs in equation 1 mentioned above.

$$Ids=k\mu(Vgs-Vth)^2=k\mu(Vsig-\Delta V)^2 \qquad \text{Equation 2}$$

In Equation 2 above, k=(½)(W/L)Cox. From Equation 2, it can be seen that the term Vth is cancelled, and that the output current Ids supplied to the light emitting element EL is not dependent on the threshold voltage Vth of the drive transistor Trd. Basically, the drain current Ids is determined by the signal potential Vsig of the video signal. In other words, the light emitting element EL emits light at a brightness that corresponds to the signal potential Vsig of the video signal. In so doing, Vsig is corrected by the feedback amount ΔV. This correction amount ΔV works to just cancel out the effect of mobility μ which is positioned at the coefficient part in Equation 2. Therefore, the drain current Ids is in effect dependent only on the signal potential Vsig of the video signal.

Finally, at timing T8, the control signal DS becomes high level, the switching transistor Tr4 turns off, and when the emission of light is terminated, the field comes to an end. Thereafter, the next field begins, and again, the Vth correction operation, the sampling operation for the signal potential, the mobility correction operation and the light emission operation are repeated.

Figure 5:
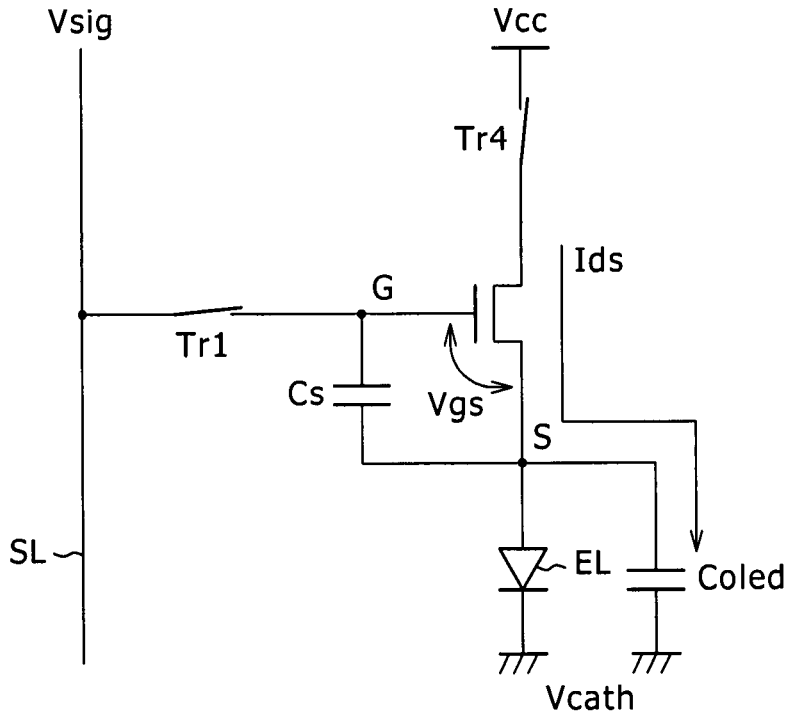
FIG. 5 is a circuit diagram that should similarly aid in explaining operations.

FIG. 5 is a circuit diagram indicating the state of the pixel circuit 2 during the mobility correction period T6-T7. As shown in the diagram, during the mobility correction period T6-T7, while the sampling transistor Tr1 and the switching transistor Tr4 are on, the remaining switching transistors Tr2 and Tr3 are off. In this state, the source potential (S) of the drive transistor Tr4 is Vss1−Vth. This source potential (S) is also the anode potential of the light emitting element EL. As described above, by setting Vss1−Vth to be smaller than VthEL in advance, the light emitting element EL is placed in a reverse bias state, and exhibits not only diode characteristics but simple capacitive characteristics as well. Therefore, the current Ids that flows through the drive transistor Trd flows into a combined capacitance of the pixel capacitance Cs and the capacitance Coled equivalent to that of the light emitting element EL (C=Cs+Coled). In other words, a portion of the drain current Ids is negatively fed back to the pixel capacitance Cs to correct the mobility.

Figure 6:
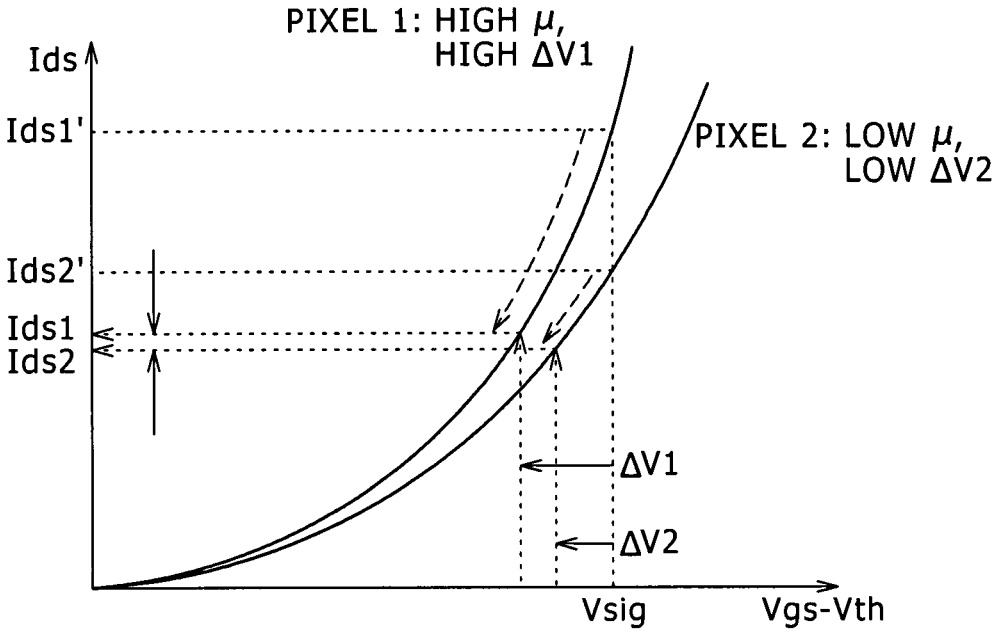
FIG. 6 is a graph that should similarly aid in explaining operations.

FIG. 6 is a diagram in which Equation 2 mentioned above is expressed as a graph, and the vertical axis represents Ids and the horizontal axis represents Vsig. Equation 2 is also indicated below the graph. The graph in FIG. 6 shows characteristic curves and compares pixel 1 and pixel 2. The mobility μ of the drive transistor of the pixel 1 is relatively large. On the contrary, the mobility μ of the drive transistor included in the pixel 2 is relatively small. When a polysilicon thin film transistor is used for formation of the drive transistor as described above, it is inevitable that mobility μ would vary from pixel to pixel. For example, when the signal potential Vsig of video signals of the same level are written in both pixels 1 and 2, if no mobility correction is performed, there would arise a great difference between an output current Ids 1' that flows through the pixel 1, whose mobility μ is large, and an output current Ids 2' that flows through the pixel 2, whose mobility μ is small. Thus, since large differences between the output currents Ids occur as a result of variations in mobility μ, uneven streaks occur, and uniformity of the screen is compromised.

As such, with the present invention, variations in mobility are cancelled out by negatively feeding back the output current to the input voltage side. As is apparent from Equation 1 above, when mobility is large, the drain current Ids becomes greater. Therefore, the negative feedback amount ΔV is greater the greater the mobility is. As indicated in the graph in FIG. 6, a negative feedback amount ΔV1 of the pixel 1, whose mobility μ is large, is greater as compared to a negative feedback amount ΔV2 of the pixel 2, whose mobility μ is small. Thus, variations can be suppressed since the negative feedback becomes greater the greater the mobility μ is. As shown in the diagram, when a correction of ΔV1 is performed for the pixel 1, whose mobility μ is large, the output current drops significantly from Ids 1' to Ids 1. On the other hand, since the correction amount ΔV2 of the pixel 2, whose mobility μ is small, is small, the output current drops from Ids 2' to Ids 2 which is not as much. As a result, Ids 1 and Ids 2 become nearly similar in value, and variations in mobility are cancelled out. Since this cancellation of variations in mobility is performed across the entire range of Vsig from the black level to the white level, uniformity of the screen becomes significantly high. Summing up the description above, when there are two pixels 1 and 2, whose mobilities are different, the correction amount ΔV1 of the pixel 1, whose mobility is large, becomes small in relation to the correction amount ΔV2 of the pixel 2, whose mobility is small. In other words, the greater the mobility is, the greater ΔV is, and thus the amount by which Ids decreases becomes greater. As a result, the current values for pixels with differing mobilities are equalized, and it thus becomes possible to correct for variations in mobility.

Hereinafter, for reference, a numerical analysis of the mobility correction will be given. As shown in FIG. 5, an analysis will be performed with the transistors Tr1 and Tr4 in an on state, and with the source potential of the drive transistor Trd taken to be variable V. Assuming that the source potential (S) of the drive transistor Trd is V, the drain current Ids flowing through the drive transistor Trd is as expressed by Equation 3 below.

$$I_{ds}=k\mu(V_{gs}-V_{th})^2=k\mu(V_{sig}-V-V_{th})^2 \qquad \text{Equation 3}$$

In addition, based on the relationship between the drain current Ids and the capacitance C(=Cs+Coled), Ids=dQ/dt=CdV/dt holds true as indicated by Equation 4 below.

$$I_{ds} = \frac{dQ}{dt} = C\frac{dV}{dt} \text{ THEN } \int \frac{1}{C}dt = \int \frac{1}{I_{ds}}dV \Leftrightarrow \quad \text{Equation 4}$$

$$\int_0^t \frac{1}{C}dt = \int_{-Vth}^{V} \frac{1}{k\mu(V_{sig} - V_{th} - V)^2}dV \Leftrightarrow$$

$$\frac{k\mu}{C}t = \left[\frac{1}{V_{sig} - V_{th} - V}\right]_{-Vth}^{V} = \frac{1}{V_{sig} - V_{th} - V} - \frac{1}{V_{sig}} \Leftrightarrow$$

$$V_{sig} - V_{th} - V = \frac{1}{\frac{1}{V_{sig}} + \frac{k\mu}{C}t} = \frac{V_{sig}}{1 + V_{sig}\frac{k\mu}{C}t}$$

Equation 3 is substituted into equation 4, and both sides are integrated. Here, the initial state of the source voltage V is −Vth, and the mobility variation correction time (T6-T7) is t. Solving this differential equation, the pixel current with respect to the mobility correction time t is given by Equation 5 below.

$$I_{ds} = k\mu\left(\frac{V_{sig}}{1 + V_{sig}\frac{k\mu}{C}t}\right)^2 \quad \text{Equation 5}$$

As described above, with a pixel circuit according to an embodiment of the present invention, variations in the mobility μ of the drive transistor as well as in the threshold voltage Vth are cancelled out, thereby preventing occurrences of uneven streaks. However, causes related to the occurrence of uneven streaks include, besides variations in the mobility and threshold voltage of the drive transistor, secondary ones as well. Secondary causes related to the occurrence of uneven streaks include, for example, discrepancies in the mobility correction amount ΔV (negative feedback amount) caused by variations in the on resistance of the switching transistor Tr4. This point will be described in detail with reference to FIG. 7. With respect to FIG. 7, it is noted that for purposes of convenience, the drive transistor Trd and the switching transistor Tr4 are designed so as to be of the same size. Unless special considerations are given, since the drive transistor Trd and the switching transistor Tr4 need only operate at the same point of operation during light emission, they usually are designed to be the same size.

Figure 7:
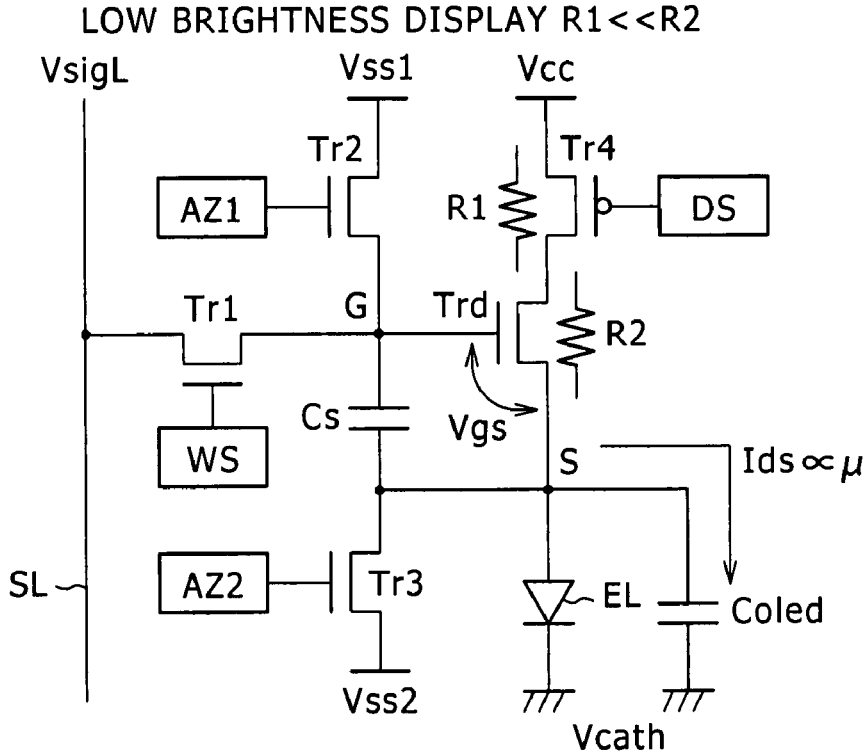
FIG. 7 is a reference diagram that should similarly aid in explaining operations.
Figure 7:
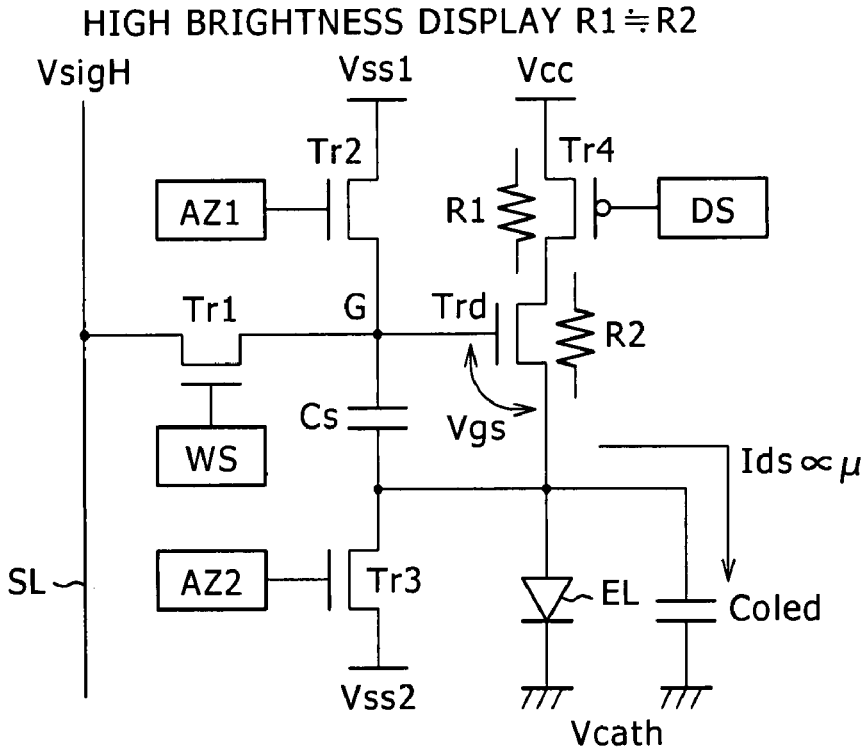

FIG. 7 indicates a circuit for one pixel, and indicates, in particular, the operation during the correction of mobility μ. The upper side indicates a case where the video signal VsigL applied to the signal line SL is low, and thus a case of low brightness display. On the other hand, the lower side indicates a case where the video signal VsigH is high, and thus a case of high brightness display. In both cases, during the mobility correction period, the drive transistor Trd and the switching transistor Tr4 turn on, and the drive current Ids is negatively fed back to the pixel capacitance Cs, thereby correcting mobility. In the diagram, the on resistance of the switching transistor Tr4 is represented as R1, and the on resistance of the drive transistor Trd is represented as R2.

During low brightness scale display, since the mobility correction amount becomes small, the drive current Ids is low. In other words, the on resistance R2 of the drive transistor Trd is high, and in comparison thereto, the on resistance R1 of the switching transistor Tr4 is extremely small. The drain node potential of the drive transistor Trd which is determined by a resistance division of R1 and R2 is hardly affected by variations in the on resistance R1 of the switching transistor, and therefore does not become a cause for variations in the mobility correction amount ΔV.

On the other hand, during high brightness scale display, the on resistance R2 of the drive transistor Trd becomes almost equal to the on resistance R1 of the switching transistor Tr4. If the on resistance R1 of the switching transistor Tr4 were to vary under this condition, the drain node potential of the drive transistor Trd, which is determined by a resistance division of R1 and R2, is easily made to vary, and the mobility correction amount ΔV also fluctuates. Thus, in the reference example in FIG. 7, when the sizes of the drive transistor Trd and the switching transistor Tr4 are comparable, variations in the on resistance R1 of the switching transistor Tr4 during high brightness display make it difficult to perform optimum mobility correction, and therefore cause uneven streaks.

As such, with the present invention, in order to prevent occurrences of uneven streaks at high brightness scale caused by variations in the on resistance of the switching transistor Tr4 described above, the size of the switching transistor Tr4 is designed to be bigger than a size of the drive transistor Trd. By enlarging the size of the switching transistor Tr4, the absolute value of the on resistance thereof decreases, and it simultaneously becomes possible to reduce variations. For example, if a size of the switching transistor Tr4 is made to be four times as large, the on resistance becomes a quarter, and variations become smaller in conjunction therewith. If the on resistance of the switching transistor Tr4 is sufficiently small, such as a quarter or less of the on resistance of the drive transistor Trd, variations in the drain node potential of the drive transistor Trd, which is determined by a resistance division of the on resistance of the switching transistor Tr4 and the on resistance of the drive transistor Trd, are also suppressed, and variations in the drive current Ids that flows during the mobility correction period also become smaller. Further, when the absolute value of the on resistance of the switching transistor Tr4 becomes smaller, variations therein also become smaller, and as a result it becomes possible to suppress occurrences of uneven streaks associated with the on resistance of the switching transistor Tr4 even during high brightness display.

As described above, a display apparatus according to an embodiment of the present invention basically includes the pixel array section 1 and the drive section that drives it. The pixel array section 1 is equipped with the first scanning lines WS, the second scanning lines DS, which are arranged in rows, the signal lines SL that are arranged in columns, the matrix pixels 2 which are provided where these lines cross one another, the power source lines Vcc that supply power to each of the pixels 2, and the earth line. On the other hand, the drive section includes the first scanner 4, which sequentially supplies the first control signal WS to the first scanning lines WS and sequentially line scans the pixels 2 row by row, the second scanner 5 which sequentially supplies the second control signal DS to each of the second scanning lines DS in conjunction with the sequential line scanning mentioned above, and the signal selector 3 which supplies video signals to the columns of signal lines SL in conjunction with the sequential line scanning mentioned above.

The pixels 2 include the light emitting element EL, the sampling transistor Tr1, the drive transistor Trd, the switching transistor Tr4, and the pixel capacitance Cs. The sampling transistor Tr1 has its gate connected with the first scanning line WS, its source connected with the signal line SL, and its drain connected with the gate G of the drive transistor Trd. The drive transistor Trd and the light emitting element EL are connected in series between the power source line Vcc and the earth line, thereby forming a current path. The switching transistor Tr4 is inserted in this current path, while its gate is connected with the second scanning line DS. The pixel capacitance Cs is connected between the source S and the gate G of the drive transistor Trd.

With this configuration, the sampling transistor Tr1 turns on in accordance with the first control signal WS supplied from the first scanning line WS, samples the signal potential Vsig of the video signal supplied from the signal line SL and holds it in the pixel capacitance Cs. The switching transistor Tr4 turns on in accordance with the second control signal DS supplied from the second scanning line DS and places the current path in a conductive state. In accordance with the signal potential Vsig held by the pixel capacitance Cs, the drive transistor Trd lets the drive current Ids flow to the light emitting element EL via the current path that is placed in a conductive state.

After the first control signal WS is applied to the first scanning line WS to turn on the sampling transistor Tr1 and the sampling of the signal potential Vsig is begun, during the correction period t from the first timing T6, at which the switching transistor Tr4 turns on as the second control signal DS is applied to the second scanning line DS, up to the second timing T7, at which the sampling transistor Tr1 turns off as the first control signal WS applied to the first scanning line WS is applied, the drive section negatively feeds back to the pixel capacitance Cs the drive current Ids that flows from the drive transistor Trd, and applies to the signal potential Vsig held by the pixel capacitance Cs a correction of $\Delta V$ that corresponds to the mobility $\mu$ of the drive transistor Trd. With the present invention, the switching transistor Tr4 is designed to be larger than a size of the drive transistor Trd so that the on resistance R1 of the switching transistor Tr4 during the mobility correction period t would be lower than the on resistance R2 of the drive transistor Trd. Preferably, the channel width size of the switching transistor Tr4 should at least be four times the channel width size of the drive transistor Trd such that the on resistance R1 of the switching transistor Tr4 becomes a quarter or less of the on resistance R2 of the drive transistor Trd.

It is noted that each of the pixels 2 includes the switching transistors Tr2 and Tr3 for resetting the gate potential (G) and the source potential (S) of the drive transistor Trd prior to the sampling of the video signal. The second scanner 5 temporarily turns on the switching transistor Tr4 via the second control line DS prior to the sampling of the video signal, and allows the drive current Ids to flow through the drive transistor Trd, which has thus been reset, thereby having a voltage corresponding to the threshold voltage thereof be held by the pixel capacitance Cs.

Figure 8:
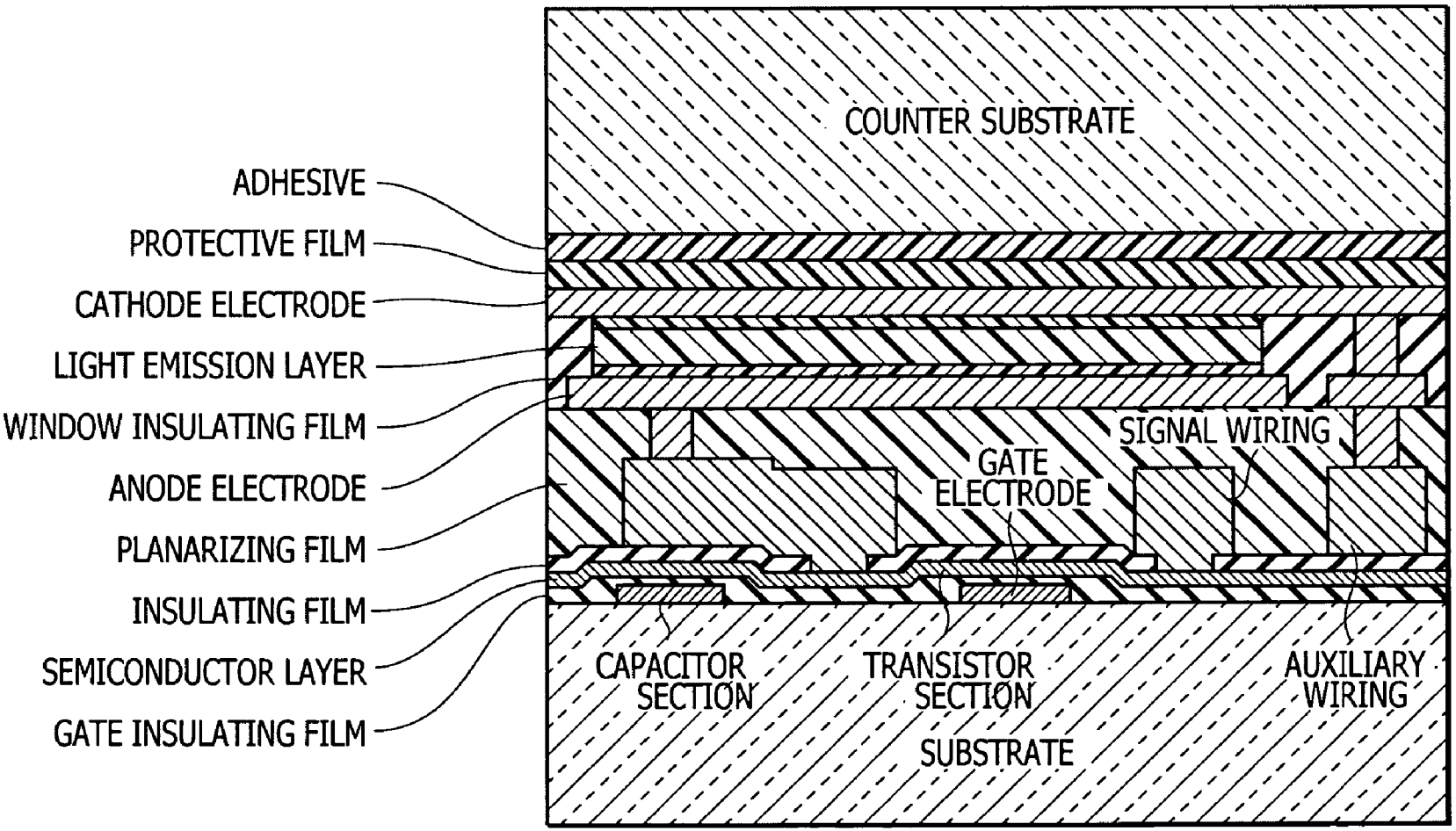
FIG. 8 is a sectional view indicating the device configuration of a display apparatus according to an embodiment of the present invention.

A display apparatus according to an embodiment of the present invention have such a thin film device configuration as the one shown in FIG. 8. FIG. 8 indicates a schematic sectional structure of a pixel that is formed on an insulative substrate. As shown in the diagram, the pixel includes a transistor section that includes a plurality of thin film transistors (in the diagram, one TFT is shown as an example), a capacitance section such as a retentive capacitance and the like, and a light emitting section such as an organic EL element and the like. The transistor section and the capacitance section are formed on the substrate through a TFT process, and the light emitting section, such as an organic EL element, is stacked thereon. A transparent counter substrate is adhered thereon via an adhesive, and a flat panel is thereby obtained.

Figure 9:
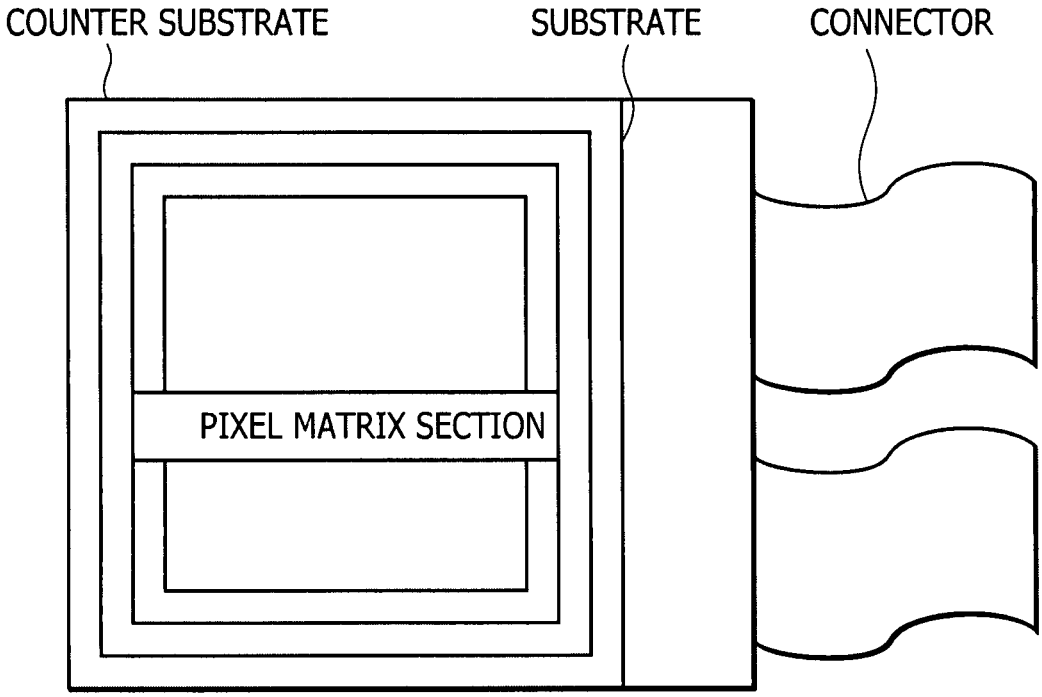
FIG. 9 is a plan view indicating the module configuration of a display apparatus according to an embodiment of the present invention.

A display apparatus related to the present invention includes a flat module type as shown in FIG. 9. For example, on an insulative substrate, a pixel array section in which pixels, each of which include an organic EL element, a thin film transistor, a thin film capacitance and the like, are integrated and formed in a matrix is provided. An adhesive is provided in such a manner that it surrounds this pixel array section (or pixel matrix section), a counter substrate of glass or the like is adhered, and a display module is thus obtained. This transparent counter substrate may be provided with a colour filter, a protective film, a light blocking film and the like as deemed necessary. The display module may be provided with, for example, an FPC (Flexible Print Circuit) as a connector for inputting and outputting signals from an external source to the pixel array section.

The display apparatus related to the present invention described above has a flat panel shape, and may be applied to the display of a variety of electronic devices, such as digital cameras, laptop personal computers, mobile phones, video cameras and the like, which display image signals that are inputted thereto or generated within as still images or as video. Below, an example of an electronic device to which such a display apparatus is applied is described.

Figure 10:
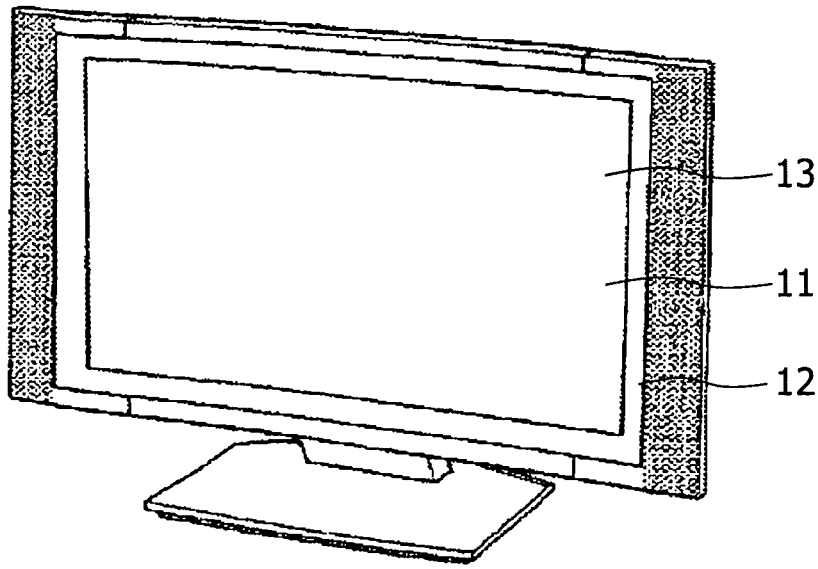
FIG. 10 is a perspective view indicating a television set that is equipped with a display apparatus according to an embodiment of the present invention

FIG. 10 shows a television set to which the present invention is applied, and includes an image display screen 11 that includes a front panel 12, a filter glass 13 and the like. It is produced by using a display apparatus of the present invention for its image display screen 11.

Figure 11:
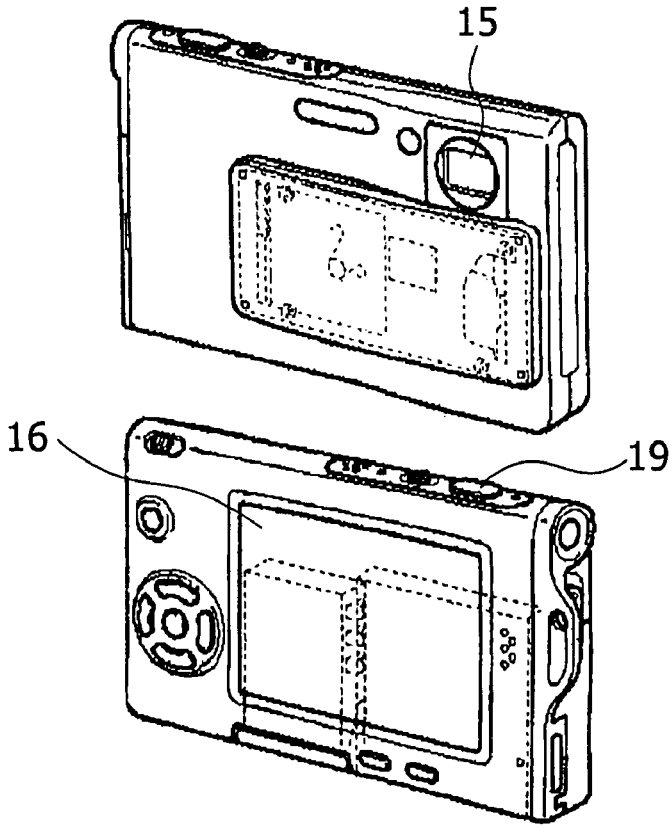
FIG. 11 is a perspective view indicating a digital still camera that is equipped with a display apparatus according to an embodiment of the present invention.

FIG. 11 shows a digital camera to which the present invention is applied, and the one on top is a front view and the one below is a rear view. This digital camera includes an imaging lens, a flash light emitting section 15, a display section 16, a control switch, a menu switch, a shutter 19 and the like, and is produced by using a display apparatus of the present invention for its display section 16.

Figure 12:
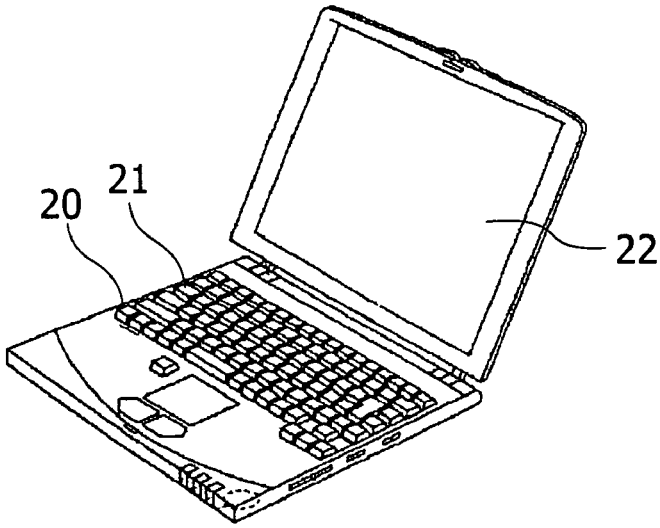
FIG. 12 is a perspective view indicating a laptop personal computer that is equipped with a display apparatus according to an embodiment of the present invention.

FIG. 12 shows a laptop personal computer to which the present invention is applied. A main body 20 includes a keyboard 21 that is operated to input text and the like, a main body cover includes a display section 22 for displaying images and the like, and this personal computer is produced by using a display apparatus of the present invention for its display section 22.

Figure 13:
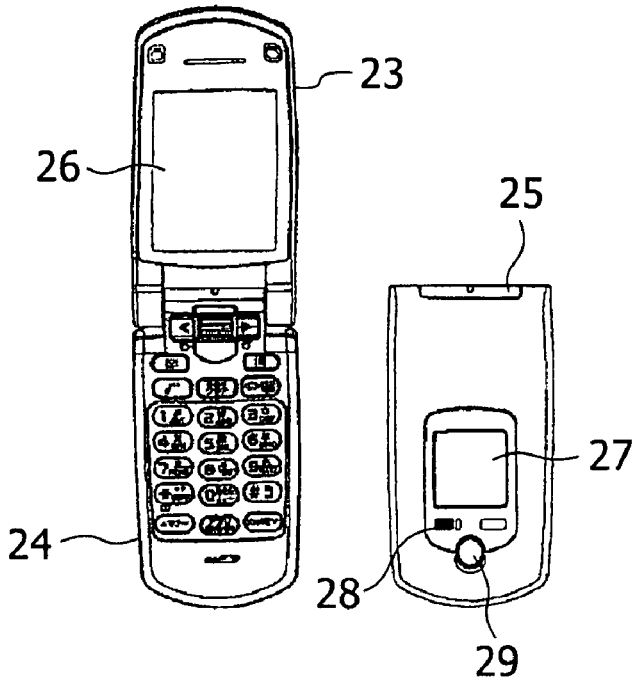
FIG. 13 is a schematic view indicating a portable terminal apparatus that is equipped with a display apparatus according to an embodiment of the present invention.

FIG. 13 shows a portable terminal apparatus to which the present invention is applied, and an opened state is shown on the left, while a closed state is shown on the right. This portable terminal apparatus includes an upper chassis 23, a lower chassis 24, a joint section (a hinge section in this case) 25, a display 26, a sub-display 27, a picture light 28, a camera 29 and the like, and is produced by using a display apparatus of the present invention for its display 26 and/or its sub-display 27.

Figure 14:
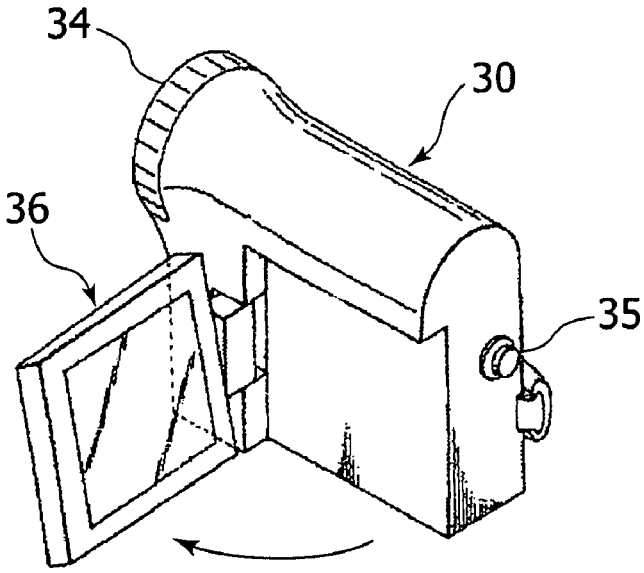
FIG. 14 is a perspective view indicating a video camera that is equipped with a display apparatus according to an embodiment of the present invention.

FIG. 14 shows a video camera to which the present invention is applied. This video camera includes a main body section 30, a subject shooting lens 34 which faces forward, a start/stop switch 35 for shooting, a monitor 36 and the like, and is produced by using a display apparatus of the present invention for its monitor 36.

The present document contains subject matter related to Japanese Patent Application No. 2006-196874 filed in the Japanese Patent Office on Jul. 19, 2006, the entire content of which being incorporated herein by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus, comprising:

a pixel array section; and a drive section that drives the pixel array section, wherein the pixel array section includes first scanning lines and second scanning lines arranged in rows, signals lines arranged in columns, matrix pixels that are provided where the first scanning lines, the second scanning lines, and the signal lines cross, and a power line that supplies power to each of the pixels, and an earth line, the drive section includes a first scanner that sequentially line scans the pixels in rows by sequentially supplying a first control signal to each of the first scanning lines, a second scanner that sequentially supplies a second control signal to each of the second scanning lines in conjunction with the sequential line scanning, and a signal selector that supplies video signals to the columns of signal lines in conjunction with the sequential line scanning, the pixel includes a light emitting element, a sampling transistor, a drive transistor, a switching transistor and a pixel capacitance, the sampling transistor has a gate connected with the first scanning line, a source connected with the signal line, and a drain connected with a gate of the drive transistor, the drive transistor and the light emitting element form a current path by being connected in series between the power line and the earth line, the switching transistor is inserted in the current path and its gate is connected with the second scanning line, the pixel capacitance is connected between a source and the gate of the drive transistor, the sampling transistor turns on in response to the first control signal supplied from the first scanning line, and samples a signal potential of the video signal supplied from the signal line and holds it in the pixel capacitance, the switching transistor turns on in response to the second control signal supplied from the second scanning line and turns the current path in a conductive state, the drive transistor allows a drive current corresponding to the signal potential held in the pixel capacitance to flow to the light emitting element via the current path that is turned in the conductive state, after starting the sampling of the signal potential by turning on the sampling transistor by applying the first control signal to the first scanning line during a correction period, the drive section negatively feeds back the drive current flowing from the drive transistor back to the pixel capacitance, and applies to the signal potential held in the pixel capacitance a correction corresponding to a mobility of the drive transistor, the correction period being a time period from a first timing at which the switching transistor turns on by having the second control signal applied to the second scanning line up to a second timing at which the sampling transistor turns off when the first control signal applied to the first scanning line is terminated and a size of the switching transistor is made to be bigger than a size of the drive transistor such that the ON-resistance of the switching transistor be lower than the ON resistance of the drive transistor.

2. The display apparatus according to claim 1, wherein the channel width size of the switching transistor is made to be at least four times of the channel width size of the drive transistor such that the ON-resistance of the switching transistor would be a quarter or less of the on resistance of the drive transistor.

3. The display apparatus according to claim 1, wherein each of the pixels includes an additional switching transistor that resets, prior to the sampling of the video signal, a gate potential and source potential of the drive transistor, and the second scanner temporarily turns on, the switching transistor via the second scanning line, prior to the sampling of the video signal, allows the drive current to flow through the drive transistor that is thus reset, and holds a voltage corresponding to a threshold voltage of the drive transistor in the pixel capacitance.

4. An electronic device comprising the display apparatus claimed in claim 1.

* * * * *